United States Patent [19]

Jeppsen

[11] 4,004,782

[45] Jan. 25, 1977

[54] MACHINE FOR MIXING AGGREGATE AND RESIN

[75] Inventor: Harvey I. Jeppsen, Mesa, Ariz.

[73] Assignee: J.I.P. Industries, Inc., Los Angeles, Calif.

[22] Filed: July 7, 1975

[21] Appl. No.: 593,551

[52] U.S. Cl. ..... 259/3; 259/154; 259/157; 259/164

[51] Int. Cl.[2] ..... B01F 7/24

[58] Field of Search ..... 259/3, 154, 157–159 R, 259/164, 165, 168, 15, 16, 30, 58, 33; 302/50, 56; 221/202, 254

[56] References Cited

UNITED STATES PATENTS

| | | | |
|---|---|---|---|
| 1,713,568 | 5/1929 | Swenson | 259/3 |
| 2,028,745 | 1/1936 | Hendrick et al. | 259/157 |
| 3,194,538 | 7/1965 | Murray | 259/3 |
| 3,670,923 | 6/1972 | Hawes, Jr. et al. | 259/154 |
| 3,762,691 | 10/1973 | Troy | 259/164 |

*Primary Examiner*—Richard E. Aegerter
*Assistant Examiner*—Willis Little
*Attorney, Agent, or Firm*—Noel B. Hammond

[57] ABSTRACT

A machine for mixing a resinous binder compound with aggregates on a continuous flow basis to produce a building material or the like, without the use of cement or water. Aggregate is fed into a first mixing chamber where a metered amount of resin binder composition is added thereto. The mixture is then passed into a first rotating mixing tube having a rotating mixing screw conveyor therein with triangular teeth between the convolutions of the screw. The outer tube rotates contra to the direction of the inner screw which produces a thorough mixing action, coating each particle of the aggregate with the resin binder composition. This mixture is then fed into a second mixing chamber where a metered amount of a second resin binder composition is mixed with the aggregate. A second mixing tube, also having a rotating mixing screw conveyor and triangular teeth, then thoroughly mixes the blend. The resultant aggregate product is then conveyed to a discharge spout. Cam-controlled hydraulic plungers tamp the aggregate in the mixing chambers to cause it to flow continuously into the mixing tubes. The angle of the triangular teeth is carefully selected to provide a thorough churning or turbulent mixing action. After the end of a run, the machine is cleaned by (1st) stopping the flow of metered binder composition, (2nd) feeding dry sand or aggregates into the second mixing chamber to scour out the second mixing chamber, the second mixing tube, and the discharge conveyor before the resin binder compounds harden, (3rd) feeding aggregate into the first mixing chamber to scour it and the first mixing tube, and flow thru the sequence of the second mixing unit.

9 Claims, 12 Drawing Figures

Fig. 3.
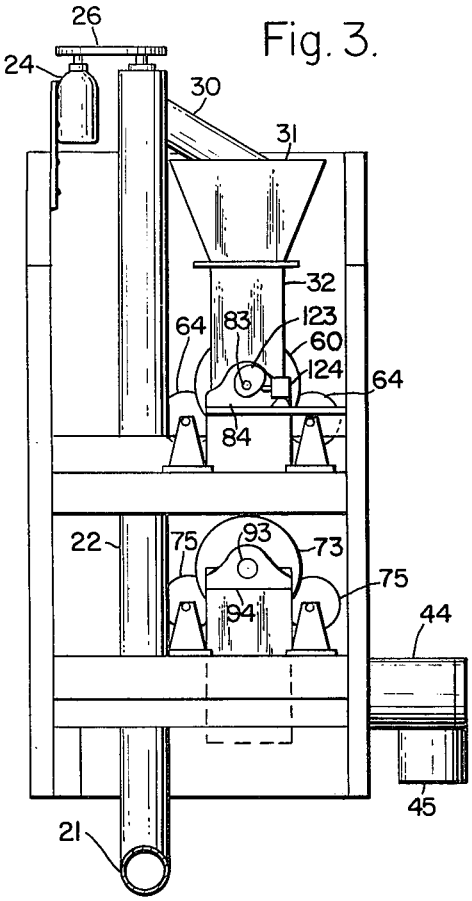
Fig. 5.
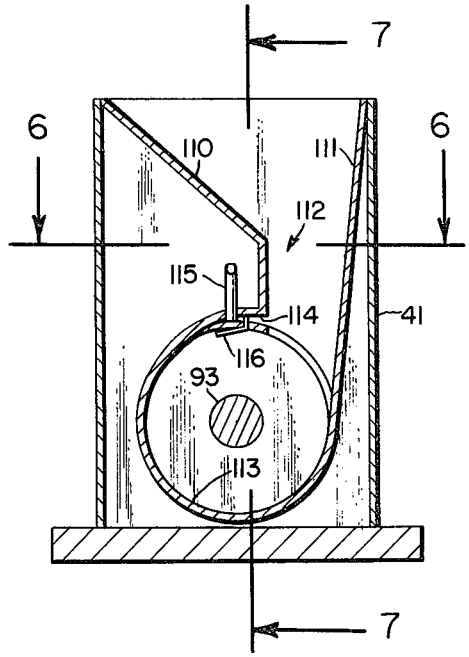
Fig. 7.
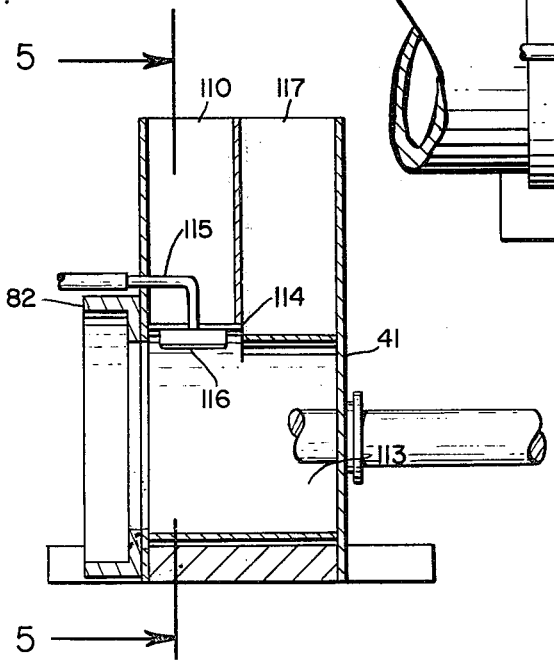
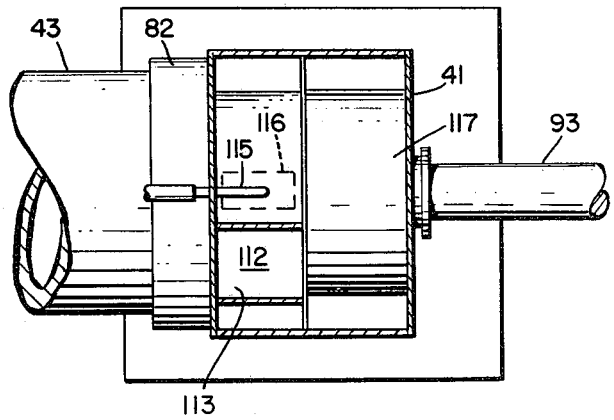
Fig. 6.

MACHINE FOR MIXING AGGREGATE AND RESIN

BACKGROUND OF THE INVENTION

It was found that there are no existing mixing machines; except for the design herein disclosed, for thoroughly mixing a resin binder compound with aggregates to produce a building material of controlled consistency. Prior art machines such as cement mixers, stirrers and machines employing simple screw conveyors, do not coat each individual particle of aggregate and can not adequately coat dust and fines with the resin compound. Furthermore, such existing machinery requires a long mixing time and is not adaptable to producing high volume, continuous-flow, quality-controlled aggregate products acceptable as structural building material.

OBJECTS OF THE INVENTION

Accordingly, it is an object of the present invention to provide a mixing machine which will uniformly coat each particle of aggregate, no matter how minute, with a resin composition.

Another object of the invention is the provision of a machine for mixing aggregate with a resin composition which will provide a continuous flow of aggregate products.

Yet another object of the present invention is to provide a machine for mixing aggregates with a resin binder component with a mixing time of 32 seconds or less, with proportionately reduced mixing times on larger capacity models.

A further object of the invention is the provision of a machine for mixing an aggregate product which has a capacity of 100 tons per hour, or more, of continuous flow.

A still further object of the present invention is to provide a mixing machine for mixing a resin binder component with an aggregate to produce an aggregate product, either at a fixed location using stationary equipment, or on the site of a construction project using portable equipment, and using aggregate or slag found on the site or native to the site.

SUMMARY OF THE INVENTION

In accordance with these and other objects of the invention there is provided a machine which mixes resin binder compositions with gradated aggregates of various sizes, including dust and fines, to produce controlled strength, waterproof aggregate products, and by eliminating the dust and fines in the mix, to produce controlled strength porous aggregate products. Both waterproof and porous products use from 2 percent to 20 percent or more of resin binder composition to the gross weight of the aggregate material used. An average of 5 percent is the predominant usage. The resin binder composition may be either a phenolic resin or a furan resin, or the like.

The resin compositions are generally available in three packages comprising the resin component in one package, the binder or hardener component in the second package, and the catalyst in the third package. The aggregate is mixed uniformly with the resin binder components in two steps or stages. The type of aggregate and density should be known in order to predetermine the order in which the resin composition is mixed with the aggregate. When the aggregate is soft, or if it is a shattered or fractured aggregate, the best results in strength are obtained if the binder component and the catalyst are mixed with the aggregate first, and then the resin component is mixed with the resultant mix. If the aggregate is of a harder structure, or a common aggregate in its natural state, then better results are obtained by first mixing the resin component with the aggregate, and then the binder component and catalyst are mixed with the resultant mix.

First the aggregate is delivered into a bin. In instances where the bin must be mounted on the face side of the machine, a horizontal screw conveyor delivers the aggregate to a vertical feed. In instances where the bin can be mounted on the reverse side of the machine, the horizontal screw conveyor can be eliminated. The vertical feed drops the aggregate into a hopper from which the aggregate falls into a mixing chamber where the first resin component is mixed with it. This resin component is in liquid form and functions as the wetting agent. From the first mixing chamber the aggregate with the first resin component is fed into a first mixing tube which has a turbulent mixing screw conveyor within it. The tube rotates contra to the rotation of the screw. Between the helices of the screw, teeth are provided which produces the thorough churning or turbulent mixing action to coat each particle of the aggregate with the resin composition. This comprises the first step or stage of the mixing process. The resultant mix is then dropped into a second mixing chamber where the second resin component, also in liquid form, is added to the mix. The aggregate then passes to a second tube mush like the first, which also has a rotating outer tube and a contra-rotating inner turbulent mixing screw conveyor with teeth between the screw helices. The resultant aggregate product then falls into a horizontal feed outlet which employs a screw conveyor to carry the aggregate product to a discharge spout where it leaves the machine.

Each of the mixing chambers is provided with a hydraulic plunger which insures that the aggregate flows smoothly into the mixing chambers. The liquid resinous binder compositions are metered into each mixing chamber by metering pumps to insure that the proper amount of binder component is added to the aggregate.

After the product is mixed and before it hardens, it is poured into a forming mold. The product is tamped or rolled, either manually or by mechanical means, to insure a uniform surface. Too much pressure should be avoided to prevent the aggregate particles from fracturing, which would weaken the overall bonding strength. If the aggregate particles fracture during the product-forming stage, a new surface at the fracture is created that is not coated with the bonding agent, and the end product is correspondingly weaker.

The aggregate product is thermosetting in ambient air having a temperature of from −30° F to 120 ° F. Working time can be controlled. A predetermined setting time can be for minutes, hours, or the next day depending on the proportions of the mix. Product curing time usually does not exceed 30 hours, however the product will reach a permanent hardness within an hour after set time and can thereafter be removed from its mold.

BRIEF DESCRIPTION OF DRAWINGS

The foregoing and other objects and features of the present invention can be more readily understood with reference to the following detailed description taken in conjunction with the accompanying drawings, wherein like reference numerals designate like structural elements, and in which:

FIG. 3 is a left side elevation of the mixing machine of FIGS. 1 and 2;

FIG. 5 is a cross-section view of one of the mixing chambers of the machine of FIGS. 1 –3;

FIG. 6 is a top plan view, partly in section, of the mixing chamber of FIG. 5, taken along the lines 6—6 of FIG. 5;

FIG. 7 is a side elevation view in cross-section of the mixing chamber of FIGS. 5 and 6, taken along the lines 7—7 of FIG. 5;

DETAILED DESCRIPTION OF THE INVENTION

The present invention is a machine for mixing resinous binder compositions with aggregates to produce a bonded aggregate building material, and the like, without the use of water or cement. The term "material" or "building material" as used herein means anything produced using an aggregate. Such products include, but are not limited to, underground tunnel walls and structures, waterway walls and dams, seamless aggregate pipelines for long-distance movement of liquids, underwater structures, decorative and sculptured products, foundations, floors, interior and exterior walls, roofs and curtain walls, decorative panels and columns, sidewalks, driveways, patio surfaces, sidewalls and floors of irrigation ditches or water viaducts, overlay surfaces for airport runways, bridges, highways and road surfaces, and the like.

Apart from building materials, the machine of the present invention may also be used to bond coal dust and fines, coke dust and fines, and raw salt.

The term "aggregate" as used herein means any rock product, sand or gravel, and includes items normally discarded as worthless, such as dust and fines (200 mesh or micro), fly ash, slags such as smelter slag, open hearth slag, blast furnace slag, electric furnace slag, and the like.

The mixing machine of the present invention is a continuous-flow mixing machine which properly mixes the materials with a mixing time of 32 seconds on a tonnage rate of 4 tons per hour. As larger capacity machines are produced this reduced mixing time will be proportionate to tonnage.

The aggregate products may be mixed at a fixed location using stationary equipment, or on the site of a construction project using portable equipment, and using aggregates or slags found on the site, or native to the site.

A machine has been built that has a capacity of four tons per hour. However, other models may be built having more or less capacity. A smaller laboratory bench model may be constructed to provide test samples of various mixes, or a commercial mixing machine for large construction projects may be built with a capacity of 100 tons per hour or more.

Figure 1:
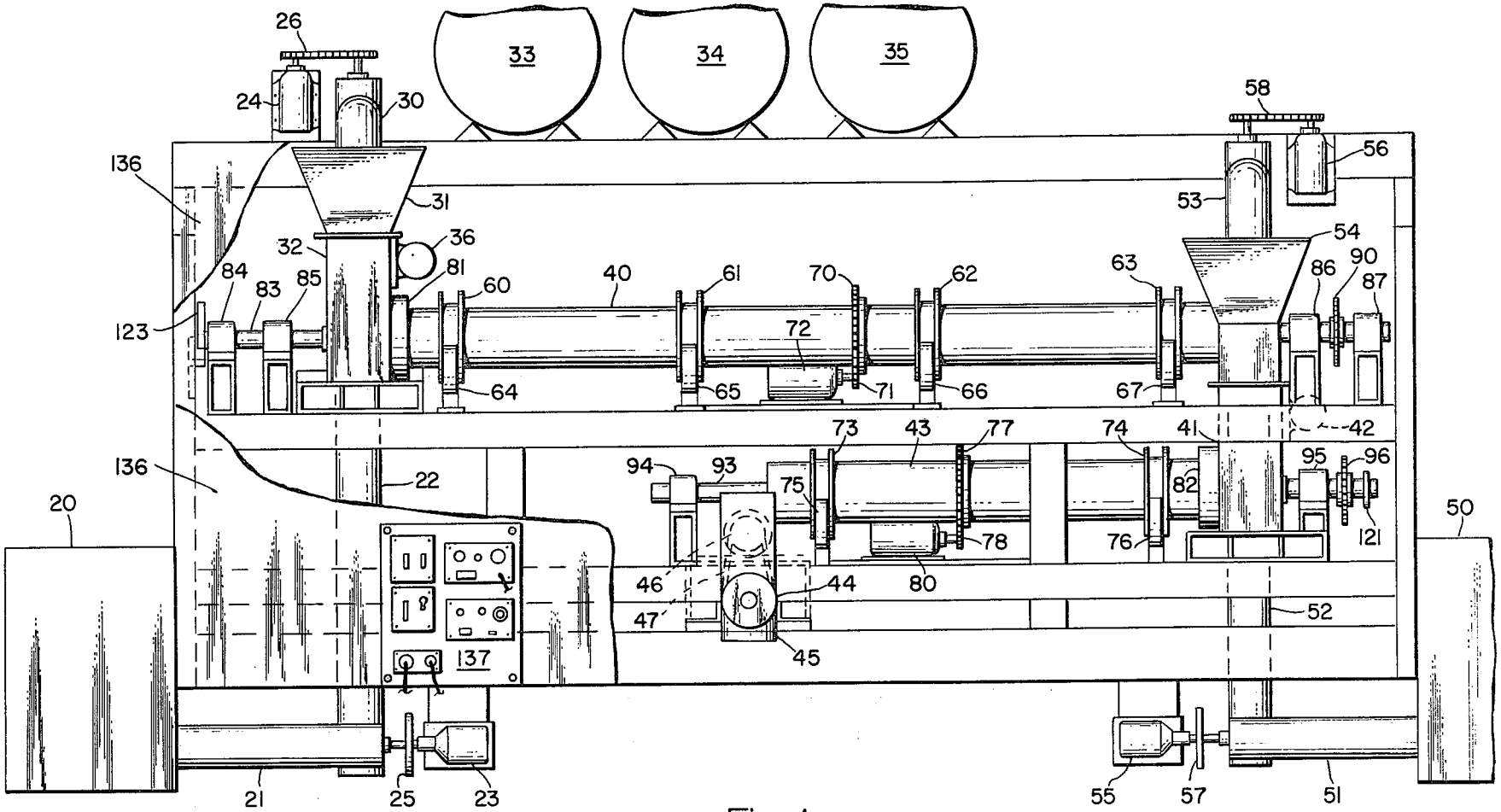
FIG. 1 is a front elevation of a mixing machine of the present invention.
Figure 2:
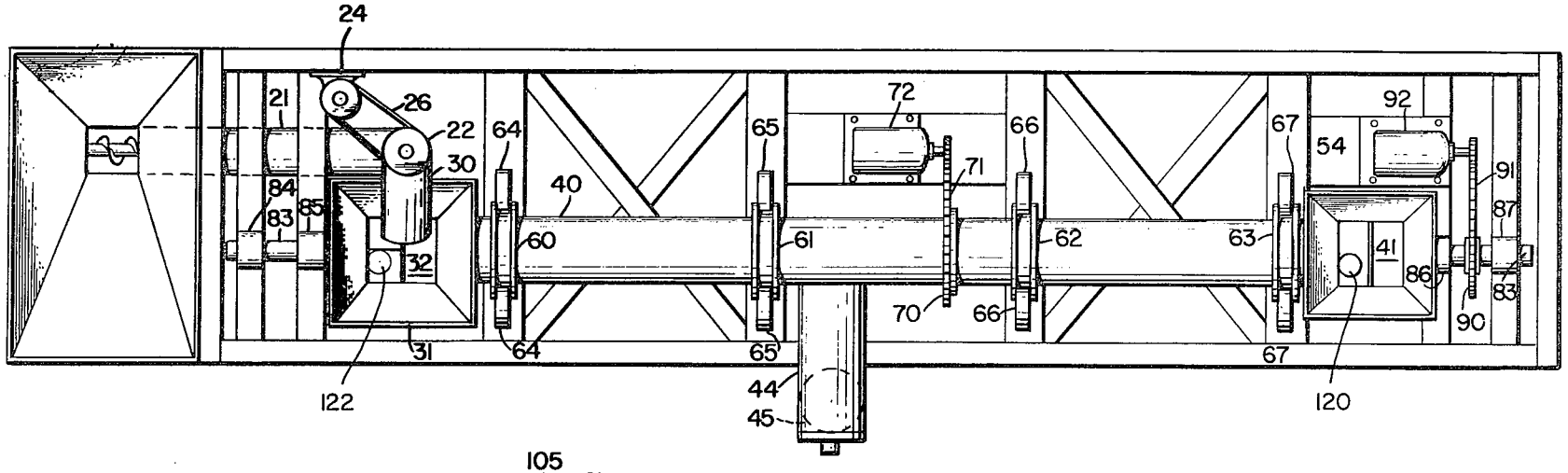
FIG. 2 is a plan view of the mixing machine of FIG. 1.

Referring now to the drawings, FIG. 1 is a front elevation of the machine, FIG. 2 is a corresponding top plan view and FIG. 3 is a side elevation of the machine. Aggregate to be bonded is placed in an aggregate bin 20 from which it is conveyed by a horizontal aggregate conveyor feed 21 to a vertical aggregate feed 22. The aggregate feeds 21, 22 are tubular and are provided with screw conveyors therein to transport the aggregates. The aggregate feeds 21, 22 are driven by electric motors 23, 24 through belt and pulley arrangements 25, 26.

The vertical aggregate feed 22 drops the aggregate down a spout 30 into a hopper 31. The aggregate then falls into a first mixing chamber 32 where it is combined with one or more of the liquid resin components that form the resin binder composition.

Several types of resin binder compostions may be employed. One is a phenolic resin binder composition in a semi-clear liquid form which maintains the natural coloration of the aggregate. Another is a furan resin binder composition which discolors the aggregate to a black or dark brown tone.

The resin compositions are generally made available in three packages: a resin component in one package, a binder or hardener component in a second package, and a catalyst in the third package. In the case of the phenolic resin binder composition, the resin component may be an organic solvent solution of a non-aqueous phenolic resin. The binder or hardener component may be a liquid polyisocyanate having at least two isocyanate groups per molecule, and the catalyst may be a tertiary amine. A description of the chemical contents and properties of a typical phenolic resin binder composition may be found in U.S. Pat. No. 3,409,579, granted Nov. 5, 1968. Typical furan resin binder composition is disclosed in Canadian Patent Number 934,492, granted Sept. 25, 1973.

The type of aggregate and its porosity must be known in order to determine the order in which the resin components are mixed with the aggregate. It has been found that better results in strength are obtained if the binder component and the catalyst are mixed with the aggregate first, and then the resin component is mixed with the resultant mix, when the aggregate is a soft aggregate or if it is a shattered or fractured aggregate. If the aggregate is of a hard nature, or is a common aggregate in its natural state, better results are obtained by first mixing the resin component with the aggregate, and then the binder component and catalyst are mixed with the resultant mix.

The liquid resin components are stored in tanks 33, 34, and 35, disposed on top of the machine. The first liquid resin component with a predetermined amount of catalyst blended therein is metered into the first mixing chamber 32 by a metering pump 36. The resinous binder composition must be mixed thoroughly with the aggregate so that the bonding agents uniformly coat each particle of aggregate regardless of the size of the particle. To this end, the aggregate and the accompanying first resin component is transported from the first mixing chamber 32 into a first mixing tube 40 where the aggregate and the first resin component are thoroughly churned and mixed. The construction and operation of the first mixing tube 40 will be more fully described hereinafter.

The aggregate with its first coating of the first resin component falls into a second mixing chamber 41 where the remaining resin component or components are added by means of a second metering pump 42. The aggregate and the liquid resin components are thoroughly mixed and churned in a second mixing tube 43. At the outlet of the second mixing tube 43, the aggregate product falls into an aggregate horizontal feed 44 where it is conveyed to an outlet spout 45. The horizontal feed 44 also employs a screw conveyor and is driven by a motor 46 and a belt and pulley arrangement 47.

The aggregate product will form or set in a controlled time of from 30 seconds to several hours, depending on the proportion of the mix or the resin components.

The end product is thermosetting in ambient air having temperature of from −30° F to 120° F. The product will set at a predetermined time, at which point it can be removed from its mold or mold form. It will cure at ambient temperature and reach its permanent hardness in a few hours, usually about 30 hours or less.

After the product is mixed and before it sets or hardens, it is poured into a form or mold. The product is tamped or rolled, either manually or by mechanical means, to insure a uniform surface. Too much pressure must be avoided to prevent the aggregate particles from fracturing, thus weakening the overall bonding strength. If aggregate particles fracture during the product-forming stage, new surfaces are created that are not coated with bonding agent, and the end product is correspondingly weaker.

After a run of aggregate products has been completed, it is necessary to clean out the second mixing chamber 41, the second mixing tube 43, and the horizontal feed 44 before any remaining aggregate product hardens therein. To that end, dry aggregate is fed into the second mixing chamber 41 to scour the aforementioned parts of the machine and eliminate any remaining aggregate product before it hardens. Aggregate or sand is placed in a sand bin 50. In instances when this bin 50 is mounted on the right side of the machine the sand is conveyed by a horizontal sand feed 51 to a vertical sand feed 52, which drops the sand out of a spout 53 into a sand hopper 54, which feeds into the second mixing chamber 41. In instances when the bin 50 is mounted on the face side of the machine, the horizontal feed conveyor 51 can be eliminated. The sand feeds 51, 52 also employ screw conveyors and are driven by electric motors 55, 56 by way of belt and pulley arrangements 57, 58.

As stated hereinbefore, it is extremely important that the resinous binder composition be thoroughly mixed with the aggregate so that the bonding agent uniformly coats each particle of aggregate regardless of the size of the particle. This is accomplished in the mixing tubes 40, 43. The first mixing tube 40 is supported for rotation by means of four collars 60, 61, 62, 63, which are fastened to the exterior of the mixing tube 40, and which ride on four pairs of hardened steel caster wheels 64, 65, 66, 67, which are fastened to the framework of the machine. The periphery of the first mixing tube 40 is fitted with a drive sprocket wheel 70 which is driven by a drive chain 71 and an electric motor 72. During the mixing process, the mixing tube 40 is constantly rotating.

Similarly, the second mixing tube 43 is provided with two collars 73, 74 which ride on two pairs of hardened steel caster wheels 75, 76. A sprocket wheel 77 is affixed to the exterior of the second mixing tube 43, and is driven by a drive chain 78 and a motor 80. The first mixing chamber 32 is provided with a collar 81 around the first mixing tube 40 which contains seals, as will be more fully explained hereinafter. Similarly, the second mixing chamber 41 also is provided with a collar 82 surrounding the second mixing tube 43, and which contains seals.

A shaft 83 extends within the first mixing tube 40 and is supported by roller bearings mounted in pillow blocks 84, 85, 86, 87. The shaft 83 is provided with a sprocket wheel 90 which is driven by a drive chain 91 and by an electric motor 92. Similarly, a shaft 93 passes through the second mixing tube 43 and is mounted on roller bearings in pillow blocks 94, 95. The shaft 93 has a drive sprocket 96 attached thereto, which is driven by a drive chain and a motor.

Figure 4:
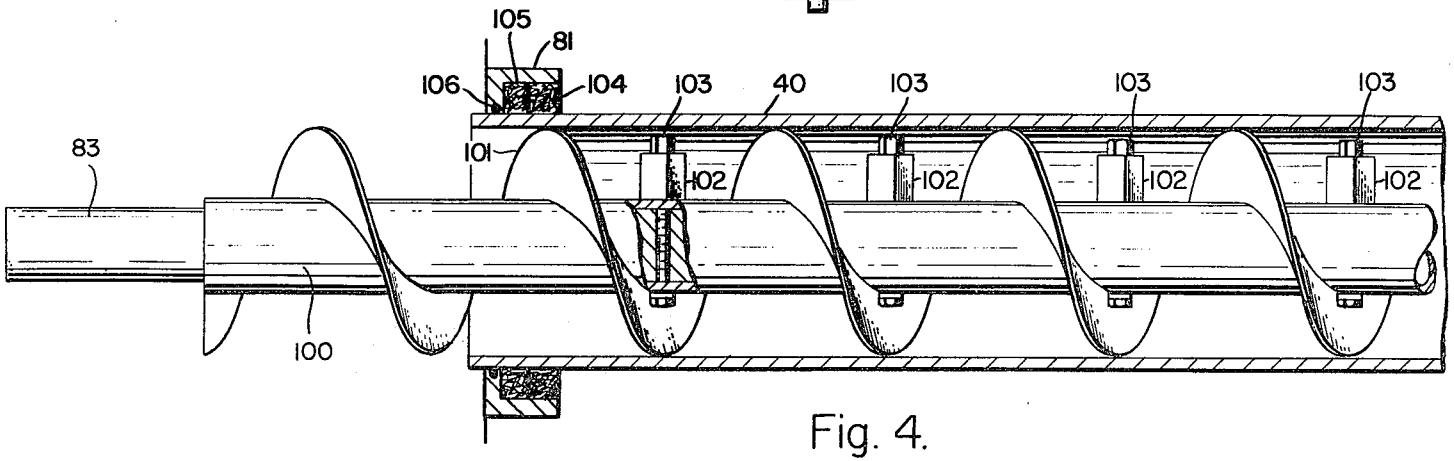
FIG. 4 is a view, partly in cross-section, of one of the mixing tubes of the machine of FIGS. 1 –3, showing the turbulent mixing screw conveyor, the teeth and the seals.

Referring now to FIG. 4, there is shown a section of the first mixing tube 40. The shaft 83 has a sleeve 100 fastened thereto. The sleeve 100 is fitted with a screw 101 and with triangular teeth 102 mounted along one side of the sleeve 100 between each spiral of the screw 101 by means of bolts 103 which pass completely through the teeth 102, sleeve 100, and shaft 83. The collar 81 at the end of the mixing tube 40 contains two leather seals 104, 105, and an "O"-ring 106. During the mixing process, both the mixing tube 40 and the shaft 83, along with sleeve 100 and the screw 101 are rotating. However, the outer tube 40 rotates in the opposite direction to the inner shaft 83, sleeve 100, and screw 101.

The second mixing tube 43 is similarly provided with a sleeve having a screw, is provided with teeth, and the outer mixing tube 43 rotates contra to the rotation of the inner shaft 93, sleeve and screw.

FIGS. 5, 6, and 7 show the construction details of the second mixing chamber 41. The construction of the first mixing chamber 32 is identical but reversed in mirror-image symmetry. The mixing chambers 32, 41 are the locations where the resin compositions are introduced into the aggregate. FIG. 5 is a cross-sectional elevation view of the second mixing chamber 41, looking toward the right, as seen in FIG. 1. The aggregate falls from above, passing along the inclined surfaces 110 and 111 which funnel it into an opening 112, where it falls into a cylindrical chamber 113. The shaft 93 of the second mixing tube 43 passes through the cylindrical chamber 113 and, by means of its screw, carries the aggregate out of the second mixing chamber 41 and through the second mixing tube 43. A portion of the cylindrical chamber 113 is pierced at 114 to permit entry of the resin composition which enters through tube 115 which is located thereat. The liquid resin composition entering through tube 115 falls against a baffle 116 and flows around the cylindrical chamber 113, where it mixes with the aggregate. One portion 117 of the mixing chamber 41 is blind.

There is a tendency for the aggregate to compact at the opening 112 of the mixing chamber 41. As the screw removes the aggregate from the cylindrical chamber 113, the aggregate above it in the opening 112 tends to bridge. To insure that the aggregate continues to fall into the cylindrical chamber 113, a hydraulic plunger 120 (best seen in FIG. 2) is provided in the mixing chamber 41 above the opening 112. The hydraulic plunger 120 is operated by a cam 121 (best seen in FIG. 1) which is attached to the right-hand end of the shaft 93 of the second mixing tube 43. The cam 121 operates a cam-follower pneumatic actuator (not shown) which actuates the hydraulic plunger, causing it to raise and lower once for each revolution of the shaft 93. Similarly, the first mixing chamber 32 is also provided with a hydraulic plunger 122 best seen in FIG. 2, which is operated by a cam 123 (best seen in FIG. 3) attached to the shaft 83 of the first mixing tube 40. The hydraulic plunger 122 is operated by means of a pneumatic drive-cam follower 124.

Figure 8:
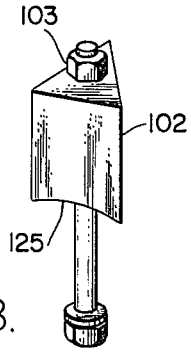
FIG. 8 is a detailed view in perspective of one of the teeth in the mixing tube of FIG. 4.
Figure 10:
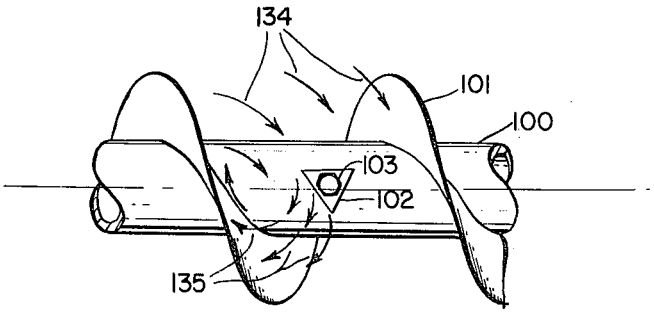
FIG. 10 is an illustration of the mixng action which takes place inside the mixing tubes of the machine of FIGS. 1–3.
Figure 9:
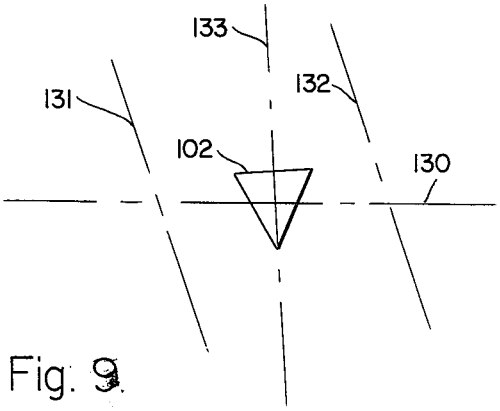
FIG. 9 is a diagrammatical illustration of the angular relationship of the teeth of FIGS. 4 and 8.

The teeth 102, which are disposed on the shafts 83, 93 in the mixing tubes 40, 43, are made in the form of equilateral triangles, as illustrated in FIG. 8. The bottom of the teeth at 125 have a curvature to match the sleeve 100. The angle of the teeth 102 is important to provide proper mixing action. Referring now to FIG. 9, line 130 corresponds to the center line of shaft 83. Lines 131, 132 represent the angle of the screw 101. Line 133 is the angle of the triangle to the tube 102. It can be seen from FIG. 9 that the angle of the tooth 102 is approximately 80° with respect to the center line 130 of the shaft 83, and is offset approximately 30° from the angle of the screw. Referring now to FIG. 10, as the screw 101 revolves, the aggregate tends to be scraped off the walls of the tube and gravitational pull, along with the forward movement of the aggregate caused by the rotation of the screw, causes the aggregate to fall toward the shaft 83, as indicated by arrows 134. The tooth 102 tends to plow into the aggregate lying at the bottom of the mixing tube 40, throwing the aggregate back on itself as indicated by arrow 135. This action causes a thorough mixing which heretofore has been unobtainable in any way except manually.

Referring back to FIG. 1, the machine is provided with side panels 136 and a control panel 137 which contains the switches and metering controls for the various drive motors and metering pumps.

Figure 11:
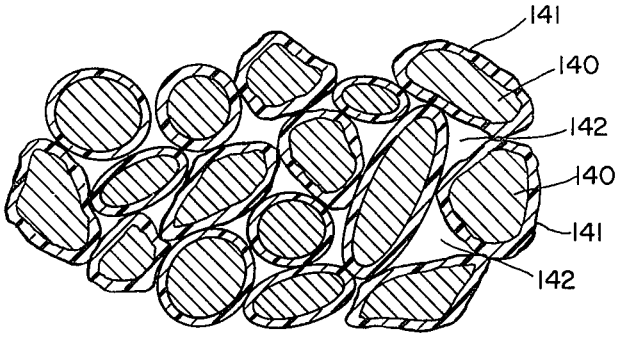
FIG. 11 illustrates in cross-section to an enlarged scale a porous aggregate product produced by the machine of FIGS. 1 – 3.

Referring now to FIG. 11 of the drawings, there is illustrated a porous aggregate material made by the machine of the present invention and shown in cross-section to an enlarged scale. The particles 140 of aggregate are of various sizes in this gradated mixture. Each individual particle 140 has a coating 141 of resin completely around it. Note the bond between the coated aggregate material 140, 141 where the resin coating 141 adheres to the coatings 141 around other particles. Due to the absence of dust and fines, the material contains voids 142 which causes the material to be porous. The porous aggregate product is particularly suitable for use as an overlay for roads, runways, and the like. It has been found that water on such surfaces is dangerous due to hydroplaning of wheels on wet surfaces. By coating roads and runways with a porous overlay made in accordance with the present invention, rain water is allowed to drain therethrough, yet the overlay coating is rigid and strong enough to support aircraft on runways, and trucks and passenger cars on roadways. The overlay material is spread on top of, and bonds itself to existing runways and roadway surfaces.

An example of a typical mix to produce such a porous product is: 50 percent of argentum smelter slag air cooled, blended with 43.3 percent silica gravel or igneous fractured rock, and mixed with a 3 percent binder, 3 percent resin, and 0.007 percent catalyst. Compressive strength of this formulation is 2,980 pounds per square inch; and, the tensile strength is 845 pounds per square inch. Both waterproof and porous products use from 2 percent to 20 percent or more of resin binder composition to the gross weight of the aggregate material used. An average of 5 percent is the predominant usage.

Figure 12:
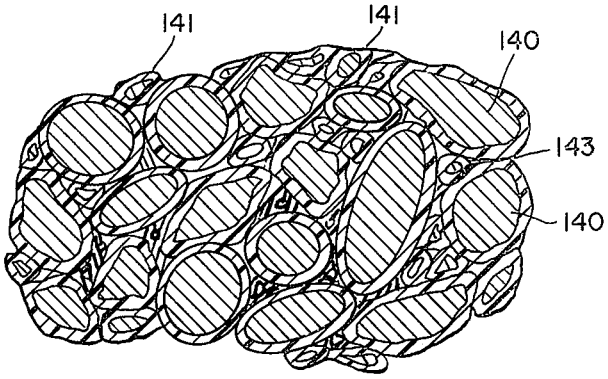
FIG. 12 illustrates in cross-section to an enlarged scale a waterproof aggregate product produced by the machine of the present invention.

FIG. 12 illustrates a waterproof aggregate product made by the machine of the present invention. This material is also made of gradated aggregate particles 140, but in addition includes dust and fines 143 which fill the voids 142. Each speck of dust and fines 143 also has a coating 141 of resin completely surrounding it, which adheres to other coatings 141. Water will not pass thru or penetrate this material.

A typical mix to produce such a waterproof product is 33.3 percent crushed quarry limestone, mixed with 33.3 percent silica blow sands, and 33.4 per cent of natural "P" gravel, one-fourth inch mesh, all mixed with 4 percent binder, 4 percent resin, and 0.005 percent catalyst. This provides a compressive strength of 6,060 pounds per square inch and a tensile strength of 1,035 pounds per square inch.

Thus, there has been described a continuous-pour mixing machine which uniformly coats every grain of aggregate with bonding agents, whereby a combination of chemicals are mixed with any of a wide range of aggregates to form various qualities of construction materials. Aggregates used can be either premium rock, or, they can be worthless drifting desert sand, or ocean beach sand, or even dust and fines. Products produced can be either waterproof throughout, or porous.

It is to be understood that the above described embodiment of the invention is merely illustrative of the many possible specific embodiments which represent applications of the principles of the present invention. Numerous and varied other arrangements can readily be devised in accordance with these principles by those skilled in the art without departing from the spirit and scope of the invention.

What is claimed is:

1. A mixing machine for mixing a particulate material with a liquid resin compound comprising:

a mixing chamber for receiving and combining said particulate material and said liquid resin compound;

a rotatably mounted mixing tube mechanically coupled to said mixing chamber for mixing and conveying said material and said compound therefrom;

a shaft having a spiral mixing screw conveyor disposed within said mixing tube;

a plurality of triangular teeth disposed along said shaft between the spirals of said spiral mixing screw conveyor; and drive means coupled to said tube and said shaft for counter-rotation thereof to provide a turbulent mixing action which coats each particle of said material with said compound.

2. The machine of claim 1 including a second mixing chamber at the outlet of said mixing tube for adding a second liquid resin compound to said material;

a second rotatably mounted mixing tube mechanically coupled to said second mixing chamber;

a second shaft having a spiral mixing screw conveyor disposed within said second mixing tube;

a plurality of triangular teeth disposed along said second shaft between the spirals of said spiral mixing screw conveyor; and drive means coupled to said second tube and said second shaft for counter-rotation thereof.

3. The machine of claim 1 including a plunger disposed in said mixing chamber and coupled to said shaft for promoting free movement of said material into said mixing chamber.

4. The machine of claim 1 including a conveyor for conveying said particulate material to said mixing chamber.

5. The machine of claim 1 including a conveyor at the outlet of said mixing tube for conveying the mixture of said material and said compound out of said machine.

6. The machine of claim 1 including means for introducing dry particulate materials into said mixing chamber after mixing is completed and after flow of said liquid resin compound is restricted for cleaning said mixing chamber and said mixing tube.

7. The machine of claim 1 including a metering pump for metering said liquid resin compound into said mixing chamber.

8. The machine of claim 1 in which said mixing tube is chain-driven and rotates on hardened steel casters.

9. The machine of claim 1 in which said shaft is supported by pillow blocks and is chain-driven.

* * * * *